United States Patent [19]

Andersen

[11] 4,268,982

[45] May 26, 1981

[54] SEAM PRESS FOR TUBULAR CLOTHING PARTS

[76] Inventor: Holger Andersen, Grönnegade 11, 8700 Horsens, Denmark

[21] Appl. No.: 957,042

[22] Filed: Nov. 2, 1978

[30] Foreign Application Priority Data

Nov. 2, 1977 [GB] United Kingdom ..... 45654/77

[51] Int. Cl.[3] ..... D06F 71/40

[52] U.S. Cl. ..... 38/12; 223/73; 223/74

[58] Field of Search ..... 38/1 B, 12, 1; 223/73, 223/74

[56] References Cited

U.S. PATENT DOCUMENTS

| | | | |
|---|---|---|---|
| 2,684,190 | 7/1954 | Glover | 223/74 |
| 2,742,206 | 4/1956 | Maxwell et al. | 223/73 |
| 2,944,710 | 7/1960 | Bader | 38/12 X |

*Primary Examiner*—Louis Rimrodt
*Attorney, Agent, or Firm*—Craig & Antonelli

[57] ABSTRACT

A seam press for tubular clothing articles, comprising a free pressing beam operable to receive an article with a seam portion thereof extending along the top side of the beam, and an elongated expander member located underneath the beam and designed and suspended so as to be generally vertically movable between an upper inactive position in which it allows for easy introduction of the article onto the beam and easy withdrawal therefrom, and a lowered operative position in which it is substantially freely flexible so as to be able to rest on the inner bottom side of the tubular clothing article and thereby stretch the article substantially uniformly throughout its length. The press is usable for pressing of seams of the single flap type without the article having to be turned the wrong side out, and preferably the pressing beam is so adapted and connected with a steam generator that steam may be supplied to the seam portion through the surface of the beam, thereby obviating the use of external pressing iron means. Preferably the expander member consists of a row of heavy tubular elements connected with means for compressing the row of elements axially to make the member stiff and liftable as a whole, while otherwise the tubular members are allowed to flex relative each other.

14 Claims, 9 Drawing Figures

SEAM PRESS FOR TUBULAR CLOTHING PARTS

Figure 1:
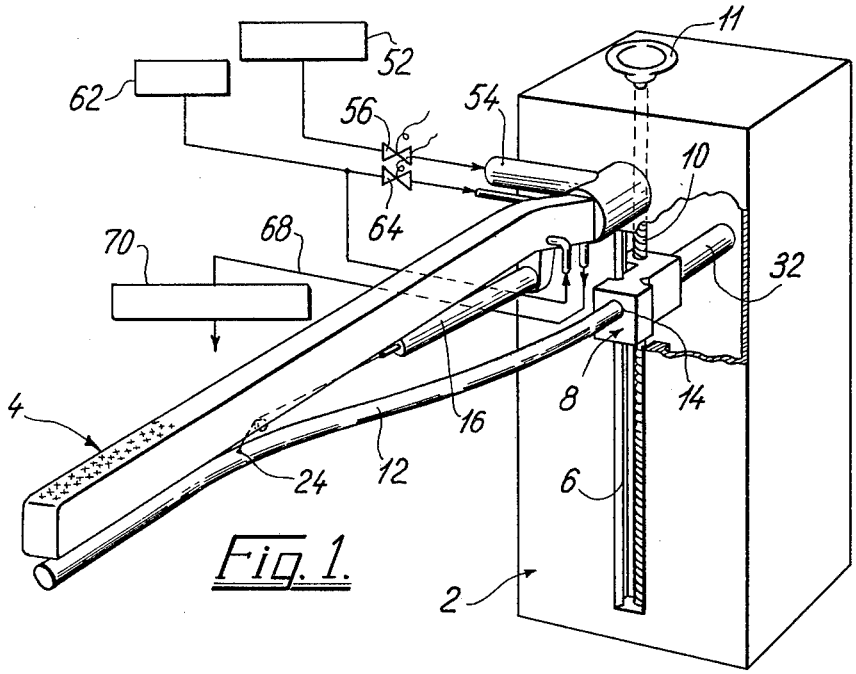

This invention relates to methods and means for pressing the elongate seam portions of trouser legs, skirts, and other tubular articles of clothing or parts of such articles. According to conventional sewing technique the seams are made so as to present on the rear side a pair of flap portions, which should be spread from each other and pressed flat against the cloth by means of a pressing iron moved along the seam, of course with the clothing part turned inside out. According to a modern and increasing popular sewing technique the seams are made as so-called "safety lock" seams in which the two flaps are sewed together to present a single double layer flap which should be folded to one side only in connection with the pressing operation. It is of course relatively easy to carry out this folding and pressing operation by moving a steam press iron along the exposed seam, though still the clothing part shall need a subsequent turning.

More specifically the invention primarily relates to the pressing of the latter type of seams, and it is the purpose of the invention to provide a pressing method whereby the folding and pressing operation can be carried out in a simplified manner.

According to the invention the tubular clothing part in right or non-turned position is introduced onto a narrow pressing beam and is manipulated from the outside such that the interior seam flap as backed by the pressing beam is folded to one side as required, whereafter the seam area is forced against the surface portion of the beam by the operator causing a pull to be exerted in the clothing part portion opposite to the seam area, and the seam area is subjected to steam pressing by means of steam supplied through the beam and through perforations in the beam surface portion engaging the seam portion to be pressed.

Hereby the seam flap folding and pressing operations are carried out sequentially, but the use of a hand held pressing iron is obviated and the clothing part should not be turned. With the use of the said pressing beam and preferably a suitable auxiliary arrangement for facilitating the exertion of the said pull this method is much faster and more convenient to carry out, compared with the hand ironing method.

It is known in the art to transversely stretch out a tubular clothing part by way of expanding it from the inside, and the said pull in the clothing part or article may advantageously be effected according to this principle. It should be noted, however, that it is important to effect the stretching out in such a manner that a sufficient pressing force is applied to the seam area all along the length thereof, i.e. an elongated expander member used for the stretching should be able to follow the inner contour of the article portion opposed to the seam to be pressed. It would not be practical to use specially designed expander members for each series of articles of a particular design, and it is an important additional purpose of the invention, therefore, to provide an expander means which may serve to produce a substantially uniform pulling force throughout the length of the article and be easily adaptable to different contours of the articles to be treated.

According to this aspect of the invention there is provided an apparatus comprising a substantial horizontal pressing beam and an elongated, flexible weight element mounted underneath the beam so as to be vertically movable between an upper inactive position in which it permits a tubular clothing part to be introduced onto the beam and weight element structure, and a lower operative position in which it rests against the inside of the lowermost portion of the tubular clothing part and in which it is freely bendable so as to be able to follow the contour of this portion of the article part and to load the same with a weight which is substantially uniform throughout the length thereof. Due to the weight element being raisable into said inactive position it will allow for free mounting and retraction of the clothing article, whereby the work is very easy to carry out. Therefore, the use of such an expander element will be advantageous whenever the tubular clothing part should be stretched out crosswise, for any purpose, not necessarily just for the said seam pressing operation.

The invention also relates to the apparatus as defined in the appended claims.

Figure 2:
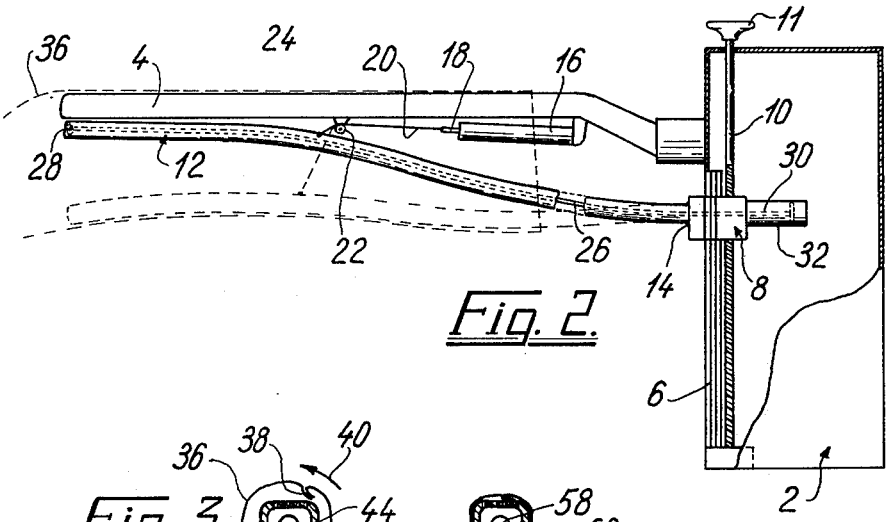
Figure 3:
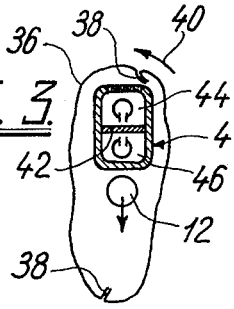
Figure 4:
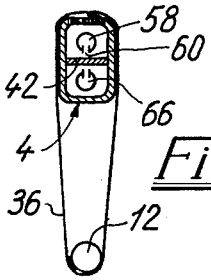
Figure 5:
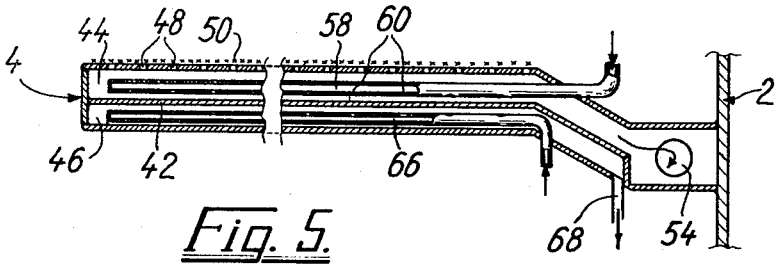
Figure 6:
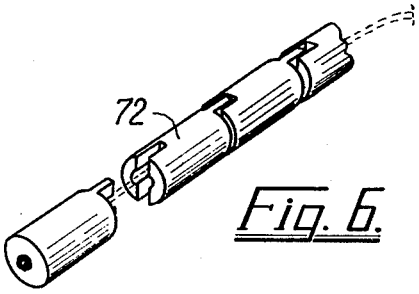
Figure 7:
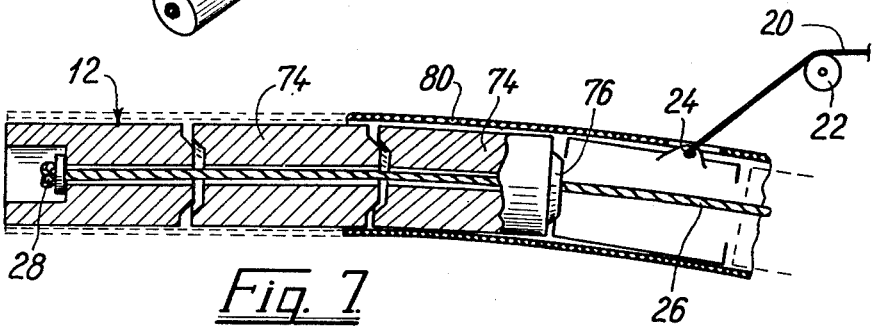
Figure 8:
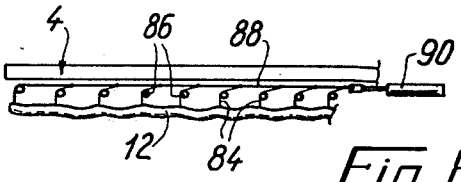
Figure 9:
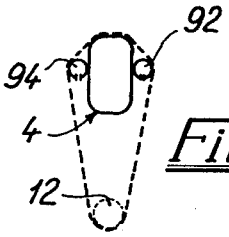

In the following the invention is described in more detail with reference to the accompanying drawing, in which:

FIG. 1 is a perspective view of a seam pressing apparatus according to the invention, FIG. 2 is a side view thereof, partly in section, FIG. 3 is an end view of the pressing beam as receiving a clothing part to be seam pressed, FIG. 4 is similar view of the clothing part being pressed, FIG. 5 is a sectional view of the pressing beam, FIG. 6 is a detailed fragmentary view of the expander member, FIG. 7 is a sectional view of a modified design of the expander member, FIG. 8 is a side view of a modified suspension of the expander member, and FIG. 9 is an end view of a modified pressing beam.

The press shown in FIG. 1 comprises a housing 2, to the front side of which is secured one end of a generally horizontally protruding beam member 4. In the front side is provided a vertical slot 6 having opposed guiding edges for a block member 8 which, by means of a screw spindle 10 having an upper hand wheel 11, is adjustable to any desired position along the slot 6. The inner end of an outwardly protruding, flexible tube member 12 is fixed at 14 to the front side of the block member 8.

As also and more clearly shown in FIG. 2 there is mounted underneath the beam 4 an air cylinder 16, the piston rod 18 of which is connected with a chain or wire 20 which passes about a guiding wheel 22 underneath the beam 4 and having its outer end connected to a fastening point 24 of the flexible tube 12, whereby the cylinder 16 may be actuated to raise and lower the tube point 24.

Centrally through the flexible tube 12 extends a pulling cable 26 which is at one end secured at 28 to the outermost end portion of the tube 12, while at the other end it extends beyond the tube end and through a hole (not shown) in the block member 8, inside which the cable end is connected with the piston rod 30 of a pneumatic cylinder 32 mounted rigidly on the rear side of the block member 8. As explained in more detail below the flexible tube 12 is so designed that it tends to straighten itself when its outer end portion is pulled towards the inner end portion by means of the cable 26, while when the cable is slackened, controlled by the cylinder 32, the tube is made free to be easily flexible; an elementary tube construction behaving in this manner will be a coil spring like structure in which the neighbouring coil windings are closely juxtaposed. The tube 12 is provided with an outer flexible mantle tubing, and it is made so as to have a relatively high weight per length unit.

It will be understood that when the cylinder 32 is actuated to exert a pull in the cable 26 the tube 12 will tend to assume a straight position projecting forwardly from the block member 8, but due to the relatively high weight of the tube such position would require an extremely strong pull in the cable 26. It is desired in the starting position of the apparatus to make the tube 12 assume a generally raised position in which at least its outer end is located closely underneath the beam, and even with a moderate pull in the cable 26 this is possible by means of the cylinder 16 which is operable to pull point 24 upwardly. Therefore, by the combined action of the two cylinders 16 and 32 the tube 12 may be held in a starting position as illustrated in full lines in FIGS. 1 and 2.

With the tube 12 in this raised position it is easy to introduce onto the beam 4 a tubular article of clothing or a part thereof, e.g. a trouser leg 36, as illustrated in FIG. 3 and in dotted lines in FIG. 2. The leg is sewed so as to have two opposed interior seam flap portions 38, and during or upon the introduction of the leg onto the beam 4 the operator manipulates the leg so as to cause the flap portion 38 adjacent the top side of the beam 4 to be laid down to the same side throughout the length of the leg, which may be done easily by moving the cloth a short distance transversely as shown by an arrow 40 while holding the seam portion against the beam top side.

Once the tubular clothing part 36 has been placed in its correct position on the beam, i.e. with the upper seam flap 38 located along the top side of the beam 4, the operator actuates an operation switch such as a pedal switch connected in a control unit so as to cause deactuation of both the cylinders 16 and 32, whereby the flexible, heavy tube 12 will fall down and get stopped by engaging the lower portion of the tubular clothing part, as illustrated in FIG. 4 and in dotted lines in FIG. 2. Due to its considerable weight the tube 12 will at any place along its length cause the side portions of the clothing part to be stretched and the top portion thereof to be drawn tightly against the top side of the beam 4, whereby the seam flap 38 is pressure stabilized in its folded position.

The time of deactuation of the cylinders 16 and 32 may be preset in said control unit such that the cylinders are automatically reactuated to cause raising of the tube 12, and the operator may then easily withdraw the clothing part from the beam and tube unit 4, 12 and mount thereon a new clothing part or the same part for pressing the opposite seam flap 38.

Normally the apparatus will be used for pressing the seam portions of a series of clothing articles direct from the confection factory, and it will be sufficient, therefore, to adjust the height of the block member 8 to each new series, such that also the innermost end of the tube 12, which has a limited vertical movability, will be operable to engage and disengage the lower side of the clothing part, according to the width thereof. The clothing parts in question may be sleeves, legs and skirts and similar parts or articles. They need not be straight cylindric, as the flexible heavy tube 12 may follow any arched or inclined contour thereof.

The apparatus so far described will be usable in a very advantageous manner even for a conventional pressing method where the clothing article or part is drawn onto the beam with the wrong side out and with a seam portion (whether of the single or double flap type) located topwise on the beam for pressing; the flexible tube or rod 12 will ensure a very firm holding of the workpiece, which is nevertheless very easy to mount and to withdraw.

Now, in order to effect a real or durable pressing it is considered necessary to apply steam to the area being pressed, and as mentioned this might well be done by means of some steam supply means located (or moved) along the top side of the beam 4. However, according to the invention, the beam 4 may itself constitute a steam supply means, the top side of the beam being perforated and the beam being hollow and connected at one end with a steam source, whereby the steam is blown through the cloth from the inside thereof.

In a preferred embodiment as illustrated in FIGS. 1, 3, 4, and 5 the detailed steam supply arrangement is as follows:

The hollow beam 4 is provided with a horizontal partition 42 dividing the beam in an upper elongated space 44 and a lower elongated space 46. The beam top side is provided with perforations 48 and covered by a netting 50 acting as a perforation distributor. The upper space 44 is connected to a vacuum source 52 (FIG. 1) through a branch tube 54 adjacent the inner end of the beam and through an automatic valve 56 controlled from said control unit (not shown). Inside the upper space 44, throughout the length thereof, is arranged a steam pipe 58 having a row of downwardly oriented steam outlet holes 60 and at its inner end being let out through the wall of the space 44 and connected to a steam source 62 through a valve 64 controlled by said control unit.

In operation, when the operator actuates the pedal switch, the cylinders 16 and 32 are deactuated to cause the tube 12 to stretch out the clothing part (FIG. 4) and immediately thereafter causing the valve 64 to open, whereby pressurized steam is admitted to the space 44, thus producing a steam outlet through the perforations 48 upwardly through the seam area as drawn against the top side of the beam 4. According to the setting of the control unit, when a predetermined steaming period has lapsed the valve 64 is closed and the vacuum valve 56 is opened, whereby the remaining steam in the space 44 is sucked out and the cloth is cooled by an inverted air flow now directed down through the perforations 48. A preset time interval thereafter the valve 56 is again closed and the cylinders 16 and 34 are reactuated to enable the operator to withdraw the pressed article from the beam 4.

The lower beam space 46 plays no role in the described operation, but it is provided as a heating space for counteracting condensation of the steam in the upper space 44. To this end the lower space 46 is provided with a steam supply tube 66 connected direct with the steam source 62 and operating to steadily supply steam to the lower space 46 to keep the same heated to such a degree that the partition 42 will remain heated and thus counteract condensation of the steam in the upper space 44. The lower space 46 is connected through a return pipe 68 to a water separator 70 taking care of the condensation water produced in this space 46.

The tube 12, of course, need not be able to follow the contour of the lower edge of the clothing article in any highly continuous manner, as the top edge portion of the article may well be drawn evenly against the beam top side even if the pull in the cloth as caused by the weight of the tube 12 is not distributed entirely uniformly along the length of the tube 12. As shown in FIG. 6, therefore, the tube may be designed in a chain-like manner so as to consist of a row of short, heavy tube elements 72 held loosely together by suitable tongue and groove means, as shown, and having a central passage for the cable 26.

A preferred construction of the flexible tube 12 is illustrated in FIG. 7. The single tube elements 74 are shaped at one end with a frustroconical protrusion 76 and at the other end with a corresponding circular recess 78, whereby the neighbouring elements are actively centering and holding each other when the cable 26 is tightened, thus tending to arrange themselves along a straight line. On the other hand, the elements may easily "break" as required for following a curved contour of the lower clothing article edge when the cable 26 is slackened. The tube elements are enclosed in an outer flex tubing 80. The inner end of the tube should not necessarily be height adjustable in a fully continuous manner, i.e. it may be supported for stepwise adjustment.

In FIG. 8 is shown a modified arrangement in which the flexible, heavy tube or rod 12 is suspended in a row of wires 84 each passing over a fixed wheel 86 and all being connected to a horizontal rod or wire 88 which is movable by means of a working cylinder 90 to cause parallel lowering and raising of the tube or rod 12; when lowered sufficiently to slacken all the wires 84 the tube or rod 12 is able to follow the configuration of the lower clothing article edge. In this case the element 12 may be a flexible hose filled with steel or lead balls or the like.

The use of the relatively heavy expander rod or tube element (weighing e.g. 5–10 kg. per meter for ordinary fabrics) is advantageous even in a still further connection, viz. for subjecting certain fabrics to a general steaming operation while the fabric is stretched out, whereby it is possible e.g. to raise the nap of velvet fabrics. To this end the apparatus according to FIGS. 1 and 5 may be provided with a further steam outlet bottomwise of the pressing beam 4, or as shown in FIG. 9 it may be preferred to arrange for steam pipes 92 mounted on both side walls of the beam 4 and having outlet holes 94 in their lower sides for injecting steam into the interior space of the tubular clothing part as stretched out by the expander element 12. Outlet holes may be provided even in the top sides of the tubes 92, but this will not be necessary when or if the beam top side is prepared for outlet of steam.

Principally, instead of operatively moving the flexible expander element 12 up and down it would be possible to effect a corresponding movement of the pressing beam. If the expander element in the embodiment shown in FIGS. 1 and 2 is adjusted generally to a low level position by lowering of the block member 8 it may happen that the lift wire 20 is not long enough for permitting operation in such a low position. It may be necessary, therefore, to interpose an extra piece of wire or to arrange the cylinder 16 to be fixably slidable along the beam 4. Besides, it would be possible to combine the two cylinders 16 and 32 so as to otherwise control the respective raising/tightening and lowering/slackening operations of the expander element.

What is claimed is:

1. A method of steam pressing the seam areas of tubular articles of clothing or parts thereof, such as trouser legs, of the type having an interior seam flap to be laid against the inside of the fabric to one side of the seam and fixed by steam pressing in this laid down position, characterized in that the tubular clothing in a right or non-turned position is introduced onto a narrow pressing beam and is manipulated from the outside in such a manner that the interior seam flap as backed by the pressing beam is caused to be laid down to one side as required, whereafter the seam area is forced against a surface portion of the beam by the operator causing a pull to be exerted in a portion of the clothing part opposite to the seam area, and the seam area is subjected to steam pressing by means of steam supplied through a channel in the beam to the inside of the seam area through perforations in the seam area backing portion of the beam.

2. Method according to claim 1, characterized in that the pull in said opposite clothing part portion is effected by lowering an elongated, flexible weight element from an inactive position just underneath the pressing beam into an active position in which it is rested against the interior top side of the lowermost clothing part portion, following the contour thereof so as to cause the seam area to be forced against the top side of the beam with a substantially uniform pressure throughout the length of the seam area.

3. An pressing apparatus for seam pressing of tubular clothing parts comprising a narrow pressing beam projecting substantially horizontally from a carrier chassis, characterized in that underneath the pressing beam there is arranged an elongated, flexible weight element connected with control means so as to be generally movable between on inactive position just underneath the pressing beam and a lowered operative position in which it is able to rest against the inner bottom side of a tubular clothing part as drawn onto the pressing beam.

4. An apparatus according to claim 3, in which the top side of the pressing beam is perforated and through these perforations connected with a channel in the pressing beam, said channel being connected or connectable with a steam generator.

5. An apparatus according to claim 4, in which either said channel or another set of perforations is connectable with a vacuum source through valve means operable to effect suction through the beam top side subsequent to a steam outlet therethrough.

6. An apparatus according to claim 3, in which the said flexible weight element is suspended so as to be generally up- and downwardly displaceable along an outermost length thereof adjacent the free end of the pressing beam, while at its innermost end the weight element is pivotally secured to a fixed, though preferably height adjustable point of said chassis.

7. An apparatus according to claim 3, in which the weight element is freely flexible in both its upper inactive position and its lower active position and is suspended in a lowerable manner in a row of points located with relatively small spacing such that the element in its raised inactive position is only slightly downwardly curved between each pair of consecutive suspension points.

8. An apparatus according to claim 3, in which the flexible weight element is made of a row of stiff element pieces provided with respective interfacing end surfaces which, when forced together in the axial direction of the weight element, cooperate so as to stabilize each pair of consecutive element pieces against flexing, said control means including means for compressing the weight element in its axial direction when it assumes its said inoperative position, such that the weight element is hereby substantially non-flexible by its own weight, the weight element being suspended for vertical movement by suspension means connected to the weight element in areas or points thereof spaced substantially from each other.

9. An apparatus according to claim 8, in which the weight element consists of a row of block bodies provided with an axial recess or bore through which extends a flexible pulling wire chain or the like which is anchored to the outermost of said block bodies and adjacent the said chassis is connected with pull exerting means so as to be operable to pull together the row of block bodies to stabilize them against flexing.

10. An apparatus according to claim 8 or 9, in which the control means are so adapted that in response to actuation thereof for raising the weight element the said element pieces are at the same time caused to be forced axially together.

11. A pressing apparatus for seam pressing a tubular clothing part comprising:

support means on which said tubular clothing part is positionable;

flexible means for contacting an inside contour portion of said tubular clothing part and stretching said parts substantially uniformly throughout the length of said inside contour portion; and means operable to cause relative movement between said flexible means and said support means.

12. The apparatus of claim 11, and further including means operable to cause said flexible means to effect a pressure on the inside of said tubular clothing parts.

13. The apparatus of claim 12, wherein said pressure is caused by the weight of said flexible means.

14. The apparatus of claim 11, wherein said flexible means comprises a row of single tube elements shaped at one end with a frusto conical protrusion and at the other end with a corresponding circular recess.

* * * * *